United States Patent [19]

Coscia

[11] 3,964,457

[45] June 22, 1976

[54] CLOSED LOOP FAST IDLE CONTROL SYSTEM

[75] Inventor: Charles M. Coscia, Columbus, Ohio

[73] Assignee: The Bendix Corporation, Southfield, Mich.

[22] Filed: June 14, 1974

[21] Appl. No.: 479,234

[52] U.S. Cl. ..... 123/119 F; 123/124 A; 123/124 B; 123/119 DB; 123/179 L; 123/32 EA; 261/41 D; 261/39 D

[51] Int. Cl.[2] ..... F02D 1/04; F02D 1/06

[58] Field of Search..... 123/119 F, 124 A, 124 B, 123/124 R, 119 DB, 102, 179 L, 97 R, 32 EA; 261/41 D, 39 D, DIG. 74

[56] References Cited

UNITED STATES PATENTS

| | | | |
|---|---|---|---|
| 3,043,286 | 7/1962 | Blomberg | 123/124 B |
| 3,661,131 | 5/1972 | Croft | 123/97 R |
| 3,677,241 | 7/1972 | Gele | 123/124 B |
| 3,750,632 | 8/1973 | Zechnall | 123/32 EA |
| 3,780,718 | 12/1973 | Nambu | 261/39 D |
| 3,797,465 | 3/1974 | Hobo | 123/139 E |
| 3,885,545 | 5/1975 | Charron | 261/39 D |

*Primary Examiner*—Charles J. Myhre
*Assistant Examiner*—Ronald B. Cox
*Attorney, Agent, or Firm*—James R. Ignatowski; William F. Thornton

[57] ABSTRACT

A closed loop fast idle control system is disclosed for controlling the idle speed of an internal combustion engine during the transitional warm-up period. The system compares the actual engine speed with a reference speed signal and controls the air delivery to the engine to minimize the difference. The reference speed signal is generated as a function of the engine's temperature. Being a closed loop control, the system automatically compensates for changes in the engine's load thereby providing for increased efficiency and a reduction in undesirable exhaust emissions.

10 Claims, 5 Drawing Figures

CLOSED LOOP FAST IDLE CONTROL SYSTEM

BACKGROUND OF THE INVENTION

1. Field of the Invention

This invention relates to the field of warm-up air delivery control for an internal combustion engine, and in particular to air delivery control during the engine start and warm-up periods generally referred to as the fast idle control, which adjusts the idle air flow to the engine controlling the engine's idle speed during the transitional warm-up period.

2. Prior Art

The requirement for a cold engine to have a substantially faster idle speed than a warm engine in order to overcome increased viscous and frictional loads encountered in a cold engine is recognized. This problem was met early in the development of internal combustion engines by what is now conventionally referred to as fast-idle controls. These controls are primarily open-looped controls having an operative duration based on the temperature of the engine or a fixed time period. Early fast-idle controls employed thermally expansive or temperature responsive devices such as bi-metallic springs to set the position of a fast idle cam controlling the idle position of the throttle in the primary air delivery system. U.S. Pat. No. 2,420,917 "Carburetor" by R. W. Sutton et al represents a typical device of the type described above. Fast idle controls of the types taught by Sutton above and variations thereof have found wide acceptance in the automotive and allied fields and are still being used today. An alternate to controlling the position of the throttle to achieve fast idle during engine warm-up, a variety of systems can be found in the prior art having a valve controlled throttle bypass air passage which admits auxiliary or idle air into the manifold at a point downstream of the closed throttle. The Eckert et al U.S. Pat. No. 3,645,509 suggests a system using an electrically heated poppet or slide valve to control the quantity of idle air being admitted into the manifold as a function of time based on the initial temperature of the engine independent of the actual rate at which the engine warms up. In another system suggested by Charron U.S. Pat. No. 3,739,760 the idle air flow is thermostatically controlled as a function of engine temperature. The Charron system also provides means for premixing a proportional quantity of fuel with the idle air prior to entering the intake manifold.

Closed loop systems for controlling an engine to run at a predetermined or operator set speed are well known in the art and are commercially available for a wide variety of automotive and aircraft applications. Although the majority of these engine speed control systems are designed to control the engine at speeds much higher than curb idle speed, Croft in U.S. Pat. No. 3,661,131 suggests that such a speed control system can be used to control the idle speed of the engine. Croft, however, only teaches the use of a fixed reference for controlling the idle speed of the engine and is ineffective as a control during the transient warm-up period where the idle speed required to sustain the operation of the engine is continuously changing.

The idle operating speed of any given internal combustion engine is primarily a function of three parameters — air, fuel and load. In the prior art systems having fast idle controls the load on the engine during the warm-up period is only considered as a function of the engine's temperature independent of the subsequent mechanical load to which the engine will be subjected during the warm-up period. A typical example of a variable load is found in automotive applications where prior to the engine warming up to its normal operating temperature, the operator may engage the engine with the transmission and ultimately the drive wheels while the engine is still cold and in its fast idle mode of operation. In order to prevent the engine from stalling, the fast idle control as taught by the prior art must be adjusted to accommodate the highest engine load anticipated which is significantly higher than that required to sustain the operation of the engine without the additional load. As a result, these open-loop systems are inefficient and wasteful adding to the already excessive exhaust pollution. On the other hand, the speed control systems of the prior art only considered the load and not the warm-up requirements of the engine.

The invention is directed to a closed-loop fast idle control which continuously controls the idle air delivery to the engine during the warm-up period to maintain the idle speed of the engine at a predetermined speed as a function of the engine temperature. Being a closed loop system, the disclosed auxiliary air delivery system automatically compensates for changes in the engine load whether it be internal to the engine itself or an external load, and changes in the idle speed required to sustain the operation of the engine as a function of its operating temperature.

SUMMARY OF THE INVENTION

The invention is a closed loop electronic auxiliary air delivery system (CLEAD System) to quickly and accurately provide auxiliary air to an internal combustion engine in order to optimize engine starting and driveability during the warm-up period while minimizing fuel consumption and undesirable emissions during this critical phase of engine operation.

The invention comprises a reference signal generator generating a signal indicative of the desired engine idle speed as a function of the engine temperature, an engine speed sensor generating a signal indicative of the engine's actual speed, a comparator, comparing the actual engine speed with the desired engine speed for generating a control signal, and a servo mechanism responsive to the control signal for actuating an air flow control mechanism tending to reduce the difference between the desired engine speed and the actual engine speed.

The engine temperature and engine speed signals used in the invention may be the conventional temperature and speed sensor embodied in electronic injector (EFI) control systems; however, it may be applied to conventional, non-EFI equipped engines with some modifications. The air flow control mechanism may be of any conventional form as discussed in the prior art, or special devices as disclosed hereinafter.

The object of the invention is an auxiliary air delivery system controlling the engine idle speed during the transient warm-up period. Another objective of the invention is a closed loop system in which the engine's idle speed is controlled as a function of the engine's temperature. Another objective is a closed loop system which during the idle mode controls the engine idle speed as a function of engine temperature and irrespective of either internal or external secondary loads applied to the engine (i.e., engaging automatic transmission). Another objective is a closed loop system which compares the actual engine speed with a desired engine speed to generate a control signal which is indicative of a change in air delivery required to cause the engine to idle at the desired speed. Another objective is to provide a system which is fully automatic. A final objective is a closed loop air control system adaptable to EFI or non-EFI equipped internal combustion engines.

DETAILED DESCRIPTION OF A PREFERRED EMBODIMENT

Figure 1:
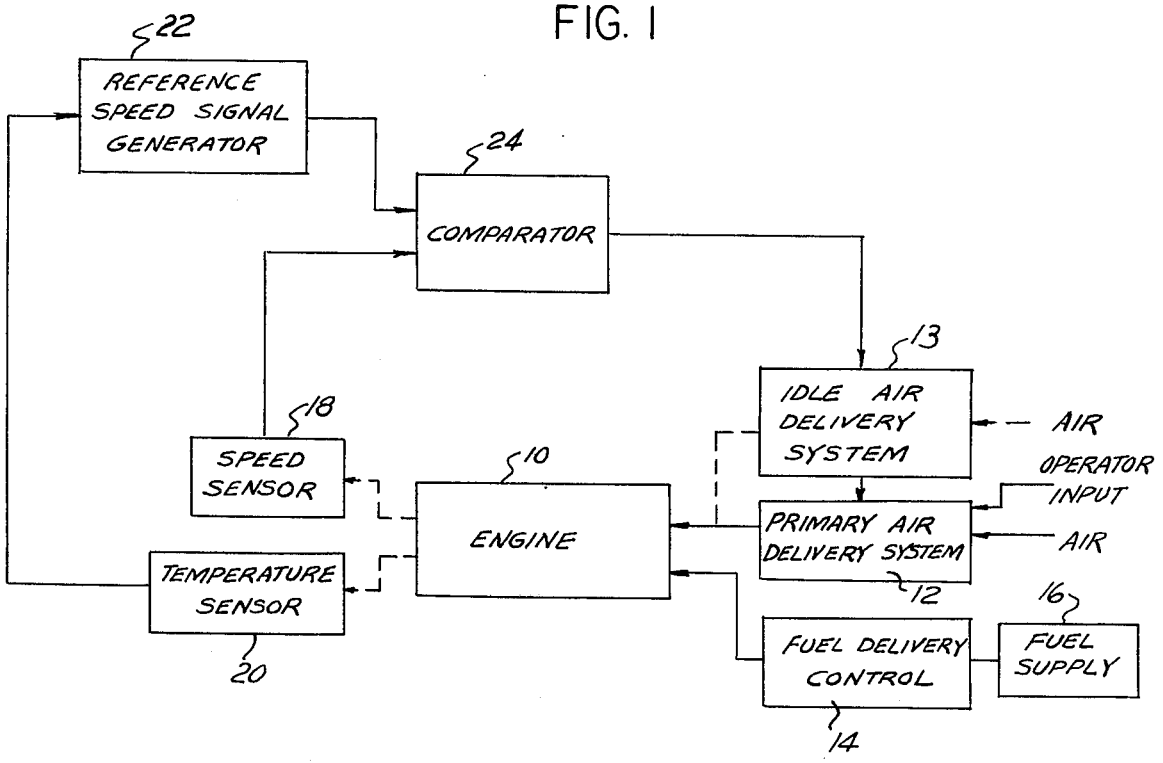
FIG. 1 is a block diagram of the disclosed loop auxiliary air delivery system.

A block diagram of the disclosed closed loop electronic auxiliary air delivery system hereinafter referred to as the CLEAD system is shown in FIG. 1. The engine 10 derives air from an external source, usually the atmosphere, through an operator actuated primary air delivery system 12. The air required to sustain the operation of the engine in the closed throttle or curb idle mode, hereinafter referred to as "idle air" is controlled by the idle air delivery system 13. The idle air delivery system may be integrated with or independent of the primary air delivery system and controls the idle speed of the engine. The idle air delivery system embodies a servo mechanism which may actuate a device controlling the position of the throttle in the primary air delivery system (solid line) as discussed relative to U.S. Pat. No. 2,420,917 or may control a valve in a throttle bypass air passage (dashed line) as discussed relative to U.S. Pat. Nos. 3,645,509 and 3,661,131.

Fuel is delivered to the engine by a fuel control device 14 from a fuel supply 16, such as a gasoline tank on an automotive vehicle. The fuel delivery control 14 may be an electronic fuel injector (EFI) control system embodying engine sensors, an electronic fuel control computer computing the desired quantity of fuel from the sensed engine operating parameters including the amount of air being inhaled by the engine, fuel injector valves, a fuel pump and other accessories necessarily attendant this type of fuel delivery system, or the fuel delivery control may be the more conventional carburetor and its attendant accessories integrated with the primary air delivery system or any other type of fuel delivery system known in the art. The combined air and fuel flow to the engine and the engine load are determinative of the actual or resultant engine speed.

Connected to the engine is an engine speed sensor 18 which generates a signal indicative of the engine's speed. The speed sensor may be of any form commonly employed such as a tachometer or sensor associated with the distributor, or associated with a mechanically moving component such as the flywheel or starter drive wheel. The exact form or source of speed information is immaterial to the invention. Also associated with the engine is a temperature sensor 20 generating a signal indicative of the engine's temperature. This temperature signal may be an electrical signal or a mechanical motion. Any of the engine temperature sensors known in the art capable of performing these functions may be used. The temperature sensed may be the temperature of the engine's block, the engine's coolant or even the temperature of the engine's oil.

The signal indicative of the engine's temperature is communicated to a reference speed signal generator 22 which in response to the temperature signal generates a reference speed signal having a predeterminable value based on the temperature of the engine and the speed determined necessary to sustain the operation of the engine at that temperature.

The reference speed signal from the reference speed signal generator 22 and the actual engine speed signal from the speed sensor 18 are compared in the comparator 24 which generates control signals indicative of the difference and direction of difference between the two speed signals. The control signal is applied to the idle air delivery system 13 which controls the idle air flow to the engine. The idle air delivery system 13 increases or decreases the idle air flow in a direction tending to reduce the difference between the reference speed signal and the actual speed signal to zero. In this manner, the fast idle operation of the engine during the starting and transient warm-up period is maintained by the CLEAD system at a speed determined by the temperature of the engine and independent of the load. Therefore, as the load on the engine changes, the CLEAD system changes the idle air flow to maintain the engine idle speed at the idle speed determined necessary to sustain the operation of the engine at the sensed engine's temperature.

Figure 2:
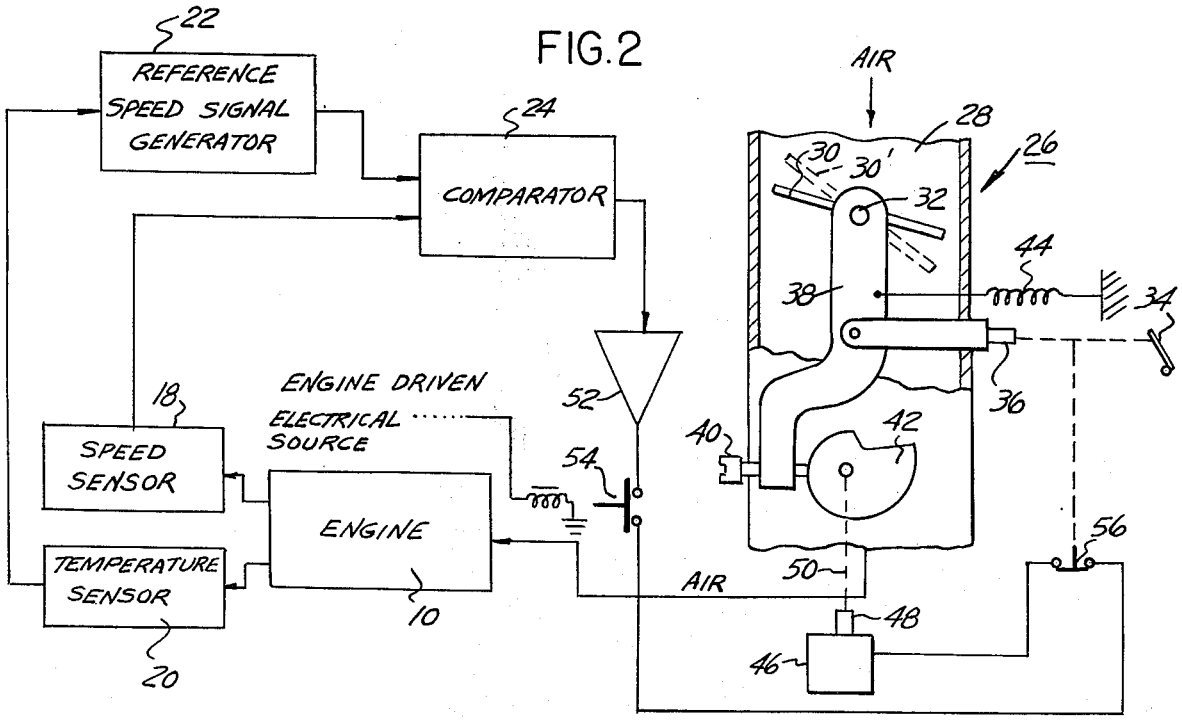
FIG. 2 is an illustration of the closed loop auxiliary air delivery system actuating a fast idle cam controlling the idle position of the throttle in the primary air delivery system.

The implementation of the CLEAD system to existing and foreseen internal combustion engine systems may take various forms. The system illustrated in FIG. 2 is directly applicable to carburetor or electronic fuel injection (EFI) equipped engines having a fast idle cam controlling the position of the throttle in the primary air delivery system. A portion of the primary air delivery system 26 having an air passage 28 conducting ambient air to the engine is shown. A throttle 30 attached to a throttle shaft 32 and rotatable therewith is actuated by the operator by means of an accelerator pedal 34 and connecting linkage 36 rotating actuator arm 38 attached to and adapted to rotate throttle shaft 32. By depressing the accelerator pedal 34, the actuator arm 38 rotates about an axis concentric with throttle shaft 32 and rotates the throttle 30 to the dashed position 30' increasing the air flow to the engine, thereby increasing the engine's speed. The idle position of the throttle is controlled by an adjustment screw threadably inserted into the end of the actuator arm opposite the end attached to the throttle shaft 32 and engaging the surface of fast idle cam 42. The adjustment screw 40 is held in engagement with the cam surface by a resilient means such as spring 44 urging the actuator arm to rotate in a direction towards the cam surface. The position of the fast idle cam 42 is controlled by a bi-directional electrically driven motor 46 mechanically linked to the cam. The cam 42 may be attached directly to the output shaft 48 of the motor 46 and rotate therewith or attached by means of mechanical linkages symbolically illustrated by dashed line 50. The position of the motor's output shaft 48 is controlled by the control signal generated by the comparator 24 through an amplifier 52. Numerous types of electronic circuitry for actuating electrical motors in response to control signals in accordance with the teaching of the invention are well known in the art including those discussed in Patent 3,661,831 and need not be discussed in detail. For example, the motor 46 may be stepper motor of the type which steps in one direction in response to a positive signal and step in the reverse direction to a negative signal or vice versa. The amplifier 52 then would only be required to generate a positive or negative signal in response to an error signal generated by the comparator above a predetermined magnitude. In other types of stepper motors which require pulse signals or signals on predetermined input leads, the amplifier 52 would be required to generate the required pulse signals or signals applied to the appropriate terminal in response to the control signals.

It would be obvious to a person skilled in the art that the motor 46 may otherwise be a high torque reversible electric motor having its output shaft connected directly to the cam 42 or connected by means of a worm gear or other mechanical linkage. Such electrically actuated servo systems are well known in the art and the applicable variations as applied to the CLEAD system are too numerous to be individually described.

It may be desirable to disable the CLEAD system during cranking of the engine. This may be accomplished by a solenoid operated switch 54 disposed between the amplifier 52 and the servo motor 46 actuated by the engine driven electrical power source. By this means the CLEAD system is deactivated during the cranking period and only becomes active after the engine has started. In the alternative, limit switches or mechanical stops may be incorporated into the system which will limit the rotation of the cam to the maximum fast idle position during the cranking period. Other circuit arrangements for setting the fast idle cam to a predetermined position or deactivating the CLEAD system during cranking would be immediately apparent to those skilled in the art. It may also be desirable to deactivate the CLEAD system when the engine's operational mode is other than the curb idle mode. This may be accomplished by a switch, such as switch 56, also disposed between the amplifier 52 and the motor 46 actuated by the accelerator pedal 34. When the operator depresses the accelerator, the engine speed increases in response to the increased air flow and the comparator would sense an engine speed greater than the reference fast idle speed and generate a control signal rotating the fast idle cam to the minimum or warm engine air flow position. The accelerator actuated switch 56 would prevent this false response by disabling the motor 46. The cam would then retain its original position. One skilled in the art will also recognize that switch 56 may be activated by a pressure sensor sensing the pressure in the intake manifold of the engine or by a signal derived from the electronic fuel control computer in EFI equipped engines. Further, it is recognized that electronic gating either within the amplifier 52 or by an auxiliary circuit could also be used to disable the CLEAD system when the engine is being cranked or not in the curb idle mode of operation. The possible ways in which the CLEAD system may be deactivated are numerous and depending upon the configuration of the engine's primary air delivery system and the auxiliary sensors available, one skilled in the art could devise a wide variety of ways to accomplish this function.

Figure 3:
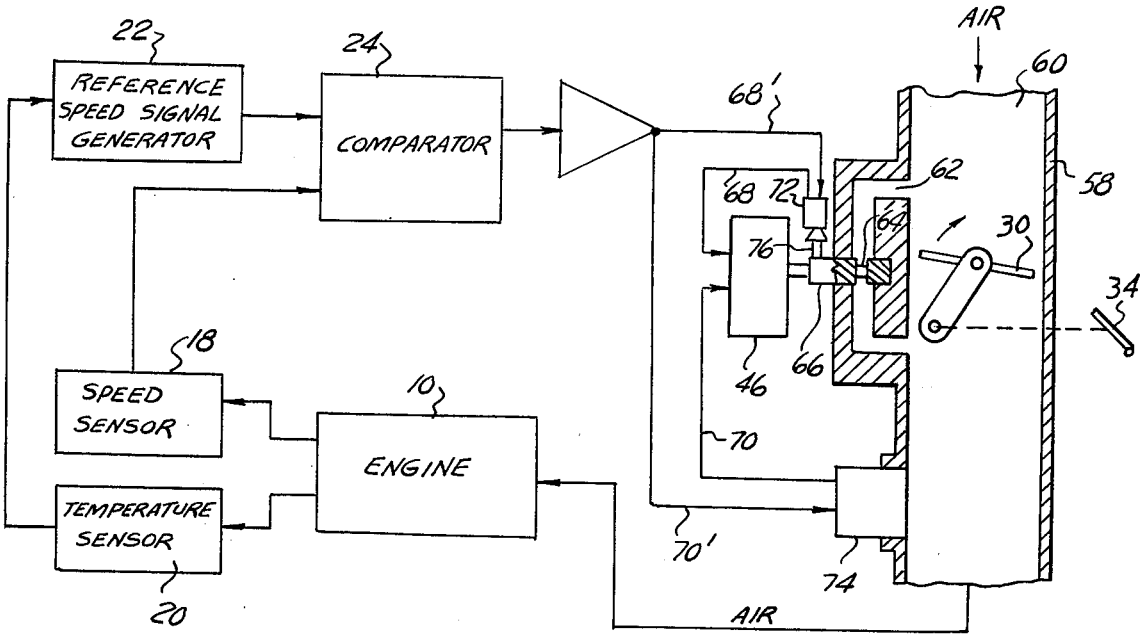
FIG. 3 is an illustration of the closed loop auxiliary air delivery system controlling the air flow through an idle bypass passage.

An alternate embodiment of the CLEAD system that may be used with a primary air delivery system having a throttle bypass auxiliary air passage for controlling the delivery of fast idle air is illustrated in FIG. 3. A portion of the primary air delivery system 58 having a primary air passage 60 is shown. The air flow through the air passage 60 is controlled by a throttle 30 actuated by the operator's accelerator pedal 34 through appropriate linkages as discussed with reference to FIG. 2. Instead of a fast idle cam controlling the position of the throttle in the idle position, the primary air delivery system 58 has a throttle bypass passage 62 ducting air from above the throttle on the high pressure side of the air delivery system to a point below the throttle on the low pressure side of the air delivery system connected to the engine. The air flow through the throttle bypass air passage 62 is controlled by a valve illustrated as an orifice 64 in a rotatable shaft 66 driven by an electric motor 46. Maximum air flow through the bypass air passage 62 is obtained when orifice 64 is aligned with the air passage and minimum air flow is obtained when the axis of the orifice is transverse to the bypass air passage. Therefore, the rotational position of shaft 66 and orifice 64 is determinative of the air flow through the bypass air passage. The operation of the CLEAD system is basically the same as discussed with reference to FIG. 2. However, FIG. 3 illustrates another way in which the CLEAD system may handle the cranking and non-idle modes of operation for the engine. In this embodiment it is assumed that the motor 46 has at least two inputs as shown. An input signal on lead 68 drives the motor in a direction tending to increase the air flow through passage 62, while an input signal on lead 70 tends to drive the motor in a direction tending to decrease the air flow through passage 62. The amplifier 52 in response to an error signal from the comparator 24 generates a signal on either lead 68' or 70' which after passing through switches 72 and 74 respectively culminate in leads 68 and 70. The switch 72 is a limit switch of any conventional form actuated by cam 76 illustrated as a pin attached to rotatable shaft 66 and rotates therewith. The pin 76 actuates the switch to the open position when the orifice 64 is in axial alignment with the air passage 62. Therefore, during the cranking of the engine when the actual engine speed signal is less than the reference speed signal, the comparator 24 generates a control signal causing amplifier to generate a signal on lead 68'. The signal on lead 68' passes through the switch 72 and drives the motor 46 tending to rotate the orifice towards the open position. When the orifice reaches the open position, the switch 72 opens and the motor stops. After the engine starts the CLEAD system senses an actual engine speed faster than the reference signal and the amplifier generates a signal on lead 70' which after passing through switch 74 drives the motor in the reverse direction and thereafter regulates the air flow through passages 62 in the disclosed manner.

The switch 74 is a pressure switch sensing the pressure in the air delivery system below the throttle 30 and is operative to open when pressure below the throttle is above a predetermined absolute pressure. Therefore, when the operator depresses the accelerator pedal 34 and opens throttle 30, the absolute pressure in the intake manifold rises above the predetermined value and switch 74 opens. However, in this mode of operation the actual engine speed is greater than the reference signal speed and the amplifier only generates a signal on lead 70'. Thereafter, the motor 46 is deactivated and the position of the shaft 66 will remain unchanged. In this manner the CLEAD system is only operative during the idle mode of operation for which it is intended.

Figure 4:
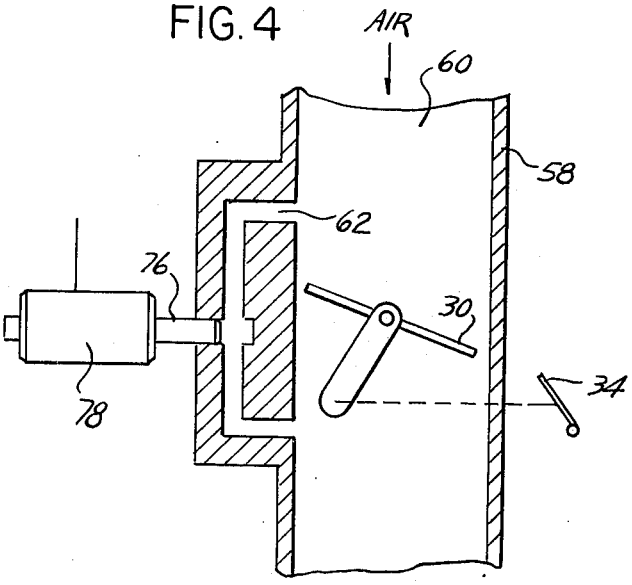
FIG. 4 is an alternate embodiment of FIG. 3.

It would be obvious in view of the above teaching that other types of valving arrangement controlling the air flow through passage 62 may be used. FIG. 4 illustrates a solenoid having a linear rather than a rotary motion performing the same function. The CLEAD electronic components are omitted to simplify the drawing but are assumed to be basically the same as shown in FIGS. 2 or 3. Air is inhaled by the internal combustion engine through the primary air delivery system 58 having a primary air passage 60. The auxiliary air determining the idle speed of the engine is bypassed around the throttle 30 through the air bypass passage 62. The air flow through the air bypass passage is controlled by a pin 76 which is linearly moved by an electrically actuated solenoid 78 to either open or close the bypass air passage. The solenoid 78 in FIG. 4 is shown in actuated state and the pin 76 is retracted from passage 62 permitting air to flow through the bypass air passage around the throttle valve. In the unactuated state the solenoid linearly moves the pin to the right and occludes the air passage 62 terminating the bypass air flow. The solenoid is actuated in response to signals from the amplifier 52.

The solenoid 78 may be a proportional solenoid where the displacement of the pin 78 into passage 62 is proportional to the signal received from the amplifier or may be of the on-off type and the air flow regulated by the duty cycle of the solenoid, i.e., "on" versus "off" time. In this latter situation, the air intake manifold of the engine downstream of the throttle functions as a large volume pressure integrator reducing the effects of the pulsed input.

When using the on-off type of solenoid, the amplifier generates a high frequency pulse signal actuating the solenoid having an "on" versus the "off" time proportional to the air flow required to maintain the engine at the desired speed as determined by the reference signal. A variety of analog and digital circuits for performing this function have been developed for automated machine tools and are known in the art.

Figure 5:
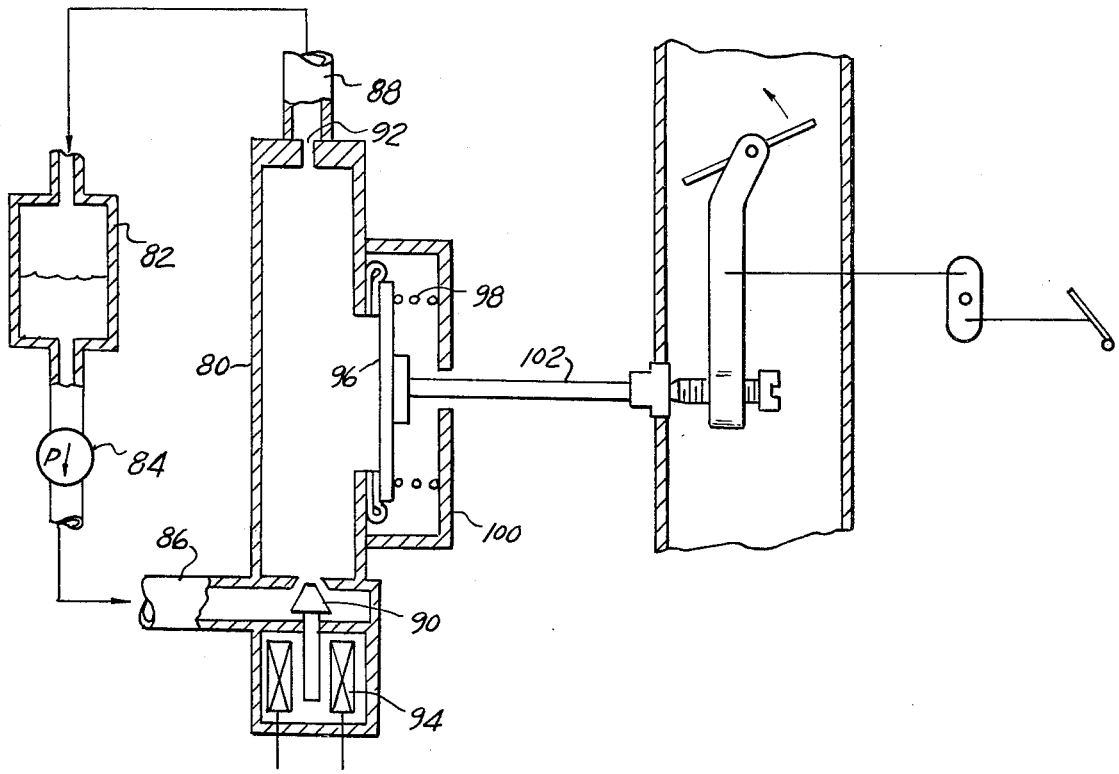
FIG. 5 is an illustration of the closed loop auxiliary air delivery system embodying a hydraulic interface.

Instead of having the solenoid directly actuating the fast idle control be it either in the form of a fast idle cam as discussed with reference to FIG. 2, or a bypass air passage as discussed relative to FIGS. 3 and 4, a hydraulic or pneumatic interface as disclosed in the Croft patent cited above may be used to control the idle air flow. FIG. 5 illustrates an embodiment of a hydraulic interface using the fuel pressure for producing the desired actuator motion controlled by a solenoid. The interface actuator comprises a cylinder 80 receiving fuel under pressure from a fuel tank 82 by means of the engine's fuel pumps 84 and inlet passage 86. The fuel is returned to the fuel tank from an outlet passage 88. The fuel pressure in the cylinder 80 is controlled by means of a valve 90 disposed in the inlet passage 86 and a throttling orifice 92 in the output passage 88. The position of valve 90 is controlled by the solenoid actuator 94. Since the fuel flow through the orifice 92 is a function of the size of the outlet orifice and the pressure of the fuel in the cylinder 80 changing the input fuel rate of flow by opening or closing valve 90 will change the fuel pressure in cylinder 80. A piston 96 exposed to the fuel pressure in the cylinder 80 will be urged outwardly to the right in the illustrated interface in response to an increase in fuel pressure against the force of a resilient member such as spring 98 constrained at one end by a housing 100 fixedly attached to the piston. The motion of the actuator shaft 102 may be used to either rotate the fast idle cam 42 illustrated in FIG. 5, position the shaft 76 shown in FIG. 4 or any other means for controlling the idle air flow to the engine previously discussed.

Although several implementations of the CLEAD system have been disclosed, the invention is not limited to those illustrated and discussed. A person skilled in the art can readily conceive a variety of alternate embodiments capable of performing the desired function. The embodiments disclosed and discussed merely illustrate some of the means for performing the control of the idle air flow during the warm-up period that may be used within the spirit of the invention.

What is claimed is:

1. An idle air delivery system for maintaining the idle speed of an internal combustion engine at a rate determined by the engine temperature comprising:

sensor means generating a speed signal indicative of the actual speed of an internal combustion engine;

sensor means generating a temperature signal indicative of the engine temperature;

reference speed generating circuit means receiving said temperature signal for generating a reference speed signal having a temperature dependent value indicative of an idle speed required to sustain the operation of the engine at the sensed engine temperature;

means comparing said actual speed signal with said reference speed signal for generating a control signal indicative of the change in the idle air flow to the engine to reduce the difference between the actual engine speed signal and the reference speed signal to zero; and means for controlling the idle air flow to the engine in response to said control signal to change the idle speed of the engine and reduce the difference between said actual speed signal and said reference speed signal to zero.

2. The idle air delivery system of claim 1 for an internal combustion engine having an operator actuated throttle controlled air delivery system wherein the idle air flow is controlled by the throttle in the primary air delivery system, said means for controlling comprises:

means for controlling the idle position of the throttle in response to said control signal.

3. The idle air delivery system of claim 2 wherein said comparator means comprises:

a comparator comparing said actual speed signal with said reference speed signal to generate an error signal indicative of the magnitude and direction of the difference between the two signals; and amplifier means responsive to said error signal for generating said control signal, said control signal applied to said throttle control means moves the throttle in a direction tending to change the idle air flow to reduce the difference between said actual speed signal and said reference speed signal.

4. The idle air delivery system of claim 1 wherein said internal combustion engine air delivery system has a throttle bypass passage for conducting the idle air delivery to the engine, said means for controlling includes valve means for controlling the air flow through said throttle bypass air passage in response to said control signal.

5. In combination with an internal combustion engine having an air delivery system and sensor means including a temperature sensor generating a temperature signal indicative of the engine's actual speed, a closed loop auxiliary air delivery system controlling the idle air flow to the engine during the transient warm-up period comprising:

means receiving said temperature signal for generating a reference speed signal having a value indicative of a desired idle speed at the sensed engine temperature;

means comparing said reference speed signal and said actual speed signal for generating a control signal indicative of the change in the idle air flow to the engine to reduce the difference between said reference speed signal and said actual speed signal to zero; and servo means receiving said control signal for controlling the idle air flow to the engine tending to maintain the actual engine speed at said desired idle speed.

6. The combination of claim 5 wherein said air delivery system has a throttle valve having an idle position, said servo means includes means for controlling the idle position of said throttle valve in response to said control signal.

7. The combination of claim 5 wherein the air delivery system has a throttle and a throttle bypass passage for conducting the idle air flow around the throttle when the throttle is in the idle position, said servo means includes means for controlling the air flow in said bypass passage in response to said control signal.

8. In an internal combustion engine system having a primary air delivery system delivering a controlled quantity of air to the engine and a fuel delivery system delivering fuel to the engine in proportion to the quantity of air being delivered, an idle air delivery system for maintaining the idle speed of the engine at a speed determinable from the engine's temperature comprising:

sensor means for generating signals indicative of the engine's temperature and signals indicative of the engine speed;

a reference speed signal generating circuit generating an engine temperature dependent reference speed signal;

a comparator circuit receiving said reference speed signal and said actual speed signal and generating a difference signal indicative of the difference between the reference speed and actual speed signals;

a control circuit receiving said difference signal and generating a control signal; and servo means receiving said control signal for controlling the idle air flow to the engine during the warm-up period, said idle air flow in combination with the primary air delivery system and the fuel delivery system operative to control the idle speed of the engine during the warm-up period as a function of the engine's temperature.

9. The system of claim 8 wherein said primary air delivery system includes a throttle controlling the idle air flow to the engine, said servo means controls the idle position of the throttle.

10. The system of claim 8 wherein said primary air delivery system includes a throttle for controlling the air flow to the engine and a throttle bypass passage delivering the idle air flow, said servo means controls the idle air flow through said throttle bypass passage.

* * * * *

UNITED STATES PATENT OFFICE

CERTIFICATE OF CORRECTION

Patent No. 3,964,457 Dated June 22, 1976

Inventor(s) Charles M. Coscia

It is certified that error appears in the above-identified patent and that said Letters Patent are hereby corrected as shown below:

Col. 5, line 7, after "direction", insert ---in response---.

Col. 6, line 67, delete "Thereafter" and insert ---Therefore---.

Signed and Sealed this

Twenty-sixth Day of October 1976

[SEAL]

*Attest:*

RUTH C. MASON
*Attesting Officer*

C. MARSHALL DANN
*Commissioner of Patents and Trademarks*